US007681275B2

(12) United States Patent
Lin et al.

(10) Patent No.: US 7,681,275 B2
(45) Date of Patent: Mar. 23, 2010

(54) DUST CLOTH TEXTURE

(76) Inventors: Pai Yung Lin, P.O. Box 46-563, Taipei, Taipei City 10499 (TW); Ya Ching Yang, P.O. Box 46-563, Taipei, Taipei City 10499 (TW)

( * ) Notice: Subject to any disclaimer, the term of this patent is extended or adjusted under 35 U.S.C. 154(b) by 1034 days.

(21) Appl. No.: 11/387,845

(22) Filed: Mar. 24, 2006

(65) Prior Publication Data

US 2007/0084005 A1 Apr. 19, 2007

(30) Foreign Application Priority Data

Oct. 17, 2005 (TW) ..... 94136223 A

(51) Int. Cl.
*A47L 13/10* (2006.01)

(52) U.S. Cl. ..... 15/209.1; 15/228; 15/208; 15/229.1

(58) Field of Classification Search ..... 15/209, 15/228, 209.1, 229.1
See application file for complete search history.

(56) References Cited

U.S. PATENT DOCUMENTS 6,245,413 B1 6/2001 Kenmochi et al.
6,491,998 B1 * 12/2002 Heitz ..... 428/92
6,813,801 B2 11/2004 Tanaka et al.
2002/0106478 A1 * 8/2002 Hayase et al. ..... 428/91

FOREIGN PATENT DOCUMENTS

TW 462275 Y * 11/2001

* cited by examiner

*Primary Examiner*—Shay L Karls

(57) ABSTRACT

The present invention relates to a dust cloth texture having fiber bundles or bundles of intermingled yarn for dusting formed on a cleaning side of a piece of nonwoven cloth by locally press-fusing. The dust cloth texture is characterized by that a plurality of press-fusing lines are formed on the dust cloth by successively splicing a plurality of closed geometric frames, whereby the lengths and directions of the fiber bundles or intermingled yarn extending outside the fusing frames are varied with the geometric shapes and line angles of the fusing lines, such that the freedom of distribution of the fibers or intermingled yarn is increased and the dusting effect is also optimized. Meanwhile, the fiber bundles or yarn inside the fusing frames are undulated to further enhance the cleaning effect of the dust cloth.

10 Claims, 7 Drawing Sheets

DUST CLOTH TEXTURE

BACKGROUND OF THE INVENTION

1. Technical Field

The present invention relates to a dust cloth texture, especially to a dust cloth texture easy to be manufactured. The dust cloth texture comprises geometric fusing frames with wide center portions and narrow margins, by which the lengths and directions of the fiber bundles or intermingled yarn extending outside the fusing frames are varied with the geometric shapes and line angles of the fusing lines, such that the freedom of distribution of the fiber bundles or yarn is increased and the dusting effect is also optimized.

2. Prior Art

Dust cloth has become very helpful to home cleaning since it is easy to use and disposable after use, which can avoid the inconvenience caused by the conventional mop, such as the necessity of cleaning the floor before mopping and the repetition of rinsing and soaking the mop. However, the early-phased dust mop that utilizes a single piece of nonwoven cloth is not sufficiently effective because the dust surface is too smooth.

Dust sheet of known dust mop is formed of a plurality of layers, for example, the cleaning sheet of U.S. Pat. No. 6,245,413, the cleaning article of U.S. Pat. No. 6,813,801, and the wipe cloth texture of the paper mop of TW Patent Publication No. 462275 all involve with the improvement of dust cloth texture, which is mainly achieved by protrusions or piles on the dust sheet that increase the dust area and possess the mopping function as capturing dust.

According to the paper mop of TW Patent Publication No. 462275, the wipe cloth texture of which is mainly formed by interlacing an upper wipe cloth and a lower wipe cloth, and a plurality of installation slots are sequentially disposed on the surfaces of the upper wipe cloth and the lower wipe cloth. However, the wipe cloth of the paper mop is flawed by the limitation in its dust capability since it is not improved in this issue.

U.S. Pat. No. 6,245,413 has provided a cleaning sheet comprising a wiping region having a wiping layer and attaching regions positioned on both sides of the wiping region, wherein a plurality of recesses are formed at intervals along boundaries between the wiping region and the attaching regions such that the recesses extend from the boundaries toward a center of said wiping region. However, it does not consider the freedom of the distribution of the piles, the sweeping range is thus limited since the lengths and directions of the piles are congruous.

Further, U.S. Pat. No. 6,813,801 has disclosed a cleaning article including a brush portion for collecting dust; said cleaning article comprises a base sheet; a fiber bundle layer of filaments disposed on a cleaning-face of said base sheet, the individual filaments extending in one direction to traverse said whole fiber bundle layer; and a cleaning-side sheet disposed on a cleaning-face of said fiber bundle layer, said cleaning-side sheet being cut from opposing edges to have a plurality of strips oriented in the same direction as the filaments, said fiber bundle layer and said cleaning-side sheet being joined to said base sheet along a longitudinal centerline of the article so that said strips and said filaments have free ends on each side of said longitudinal centerline to thereby provide brush portions, wherein a holding space, into which a hand of a user or a holder is to be inserted, is formed between said base sheet and a holding sheet disposed on a face of said base sheet opposite from the cleaning-face, said holding space being located above said fiber bundle layer and said cleaning-side sheet in a thickness direction of the article. However, in spite of the effect on prohibiting the tangle of the piles, it is complicated and costs highly to manufacture the multi-layer texture of the multi-sheet design for prohibiting the tangle of the piles, and, as the same as the cleaning sheet of the aforementioned patent and all the existing cleaning sheets on the market, the multiple sheets of which also comprise piles of uniform length, where the piles are not interlaced to enhance the dust collecting capability to improve the sweeping effect.

According to the above, all the mops of the prior art lay stress on tight conjunction with the floor, and their wiping portions are designated to be a flat surface or of a predetermined height, by which though better wiping effect can be obtained, the particles in the dust tend to scratch the article to be cleaned due to the lack of room for accommodating the particles of big size. Besides, the fiber bundles in the wiping region that actually participate in cleaning are stably fixed to the base of the sheet, thereby the movement flexibility thereof is also limited and it is thus difficult to effectively capture the dust with the mop.

Therefore, the present invention is proposed in view of the shortcomings of the aforementioned inventions.

SUMMARY OF THE INVENTION

A dust cloth texture having fiber bundles or bundles of intermingled yarn for dusting formed on a cleaning side of a piece of nonwoven cloth by connection is proposed. A plurality of connecting lines are formed on the dust cloth by successively or non-successively splicing a plurality of closed or open geometric frames, whereby the lengths and directions of the fiber bundles or intermingled yarn extending outside the fusing frames are varied with the geometric shapes and line angles of the fusing lines, such that the freedom of distribution of the fiber bundles or yarn is increased for capturing dust within the mop and the dusting effect is also optimized. Meanwhile, the fiber bundles or intermingled yarn inside the fusing frames are undulated to further enhance the cleaning effect and to provide room for accommodating dust particles to prevent scratches of the article to be cleaned.

DETAILED DESCRIPTION

It is an object of the present invention to provide a dust cloth texture easy to be manufactured, which comprises geometric fusing lines with wide center portions and narrow margins, whereby the extending directions, lengths, and widths of the fiber bundles or yarn are varied such that the movement freedom of the fiber bundles or yarn is increased and the dusting effect is also optimized.

Descriptions of the preferred embodiments are provided hereinafter along with the accompanying drawings for better understanding of the contents and features of the present invention.

As shown in FIG. 1 to FIG. 7, the dust cloth texture of the design of the present invention comprises fiber bundles or segmented intermingled yarn (2) for dusting formed on a piece of nonwoven cloth (1) of hot melt material by locally press-fusing, wherein a plurality of fusing lines (3) are formed with two major end portions (31) of a geometric shape narrowing at two sides, a wide portion (32) in the center, a sub-wide portion (33) in between the end portions (31) and wide portion (32), and a successively spliced traversing link frame (34) of a geometric shape.

As a result, the nonwoven cloth (1) and the fiber bundles or yarn (2) are easier to be manufactured since PET fiber bundles or yarn (2) and PET nonwoven cloth (1), or PP fiber bundles or yarn (2) and PP nonwoven cloth (1) are cut and fused together at the same time. Moreover, as the resulted dust cloth comprises the geometric fusing lines (3) with wide center portions and narrow margins thereon, the lengths and widths of the fiber bundles or yarn (2) are varied such that the movement freedom of the fiber bundles or yarn (2) is increased for capturing dust within the mop, whereby enhancing the dusting effect.

Referring to FIG. 2 to FIG. 4, in practice of the present invention, there are widened press-fusing margins (35) disposed on the outer sides of the entire fusing lines (3) additionally. Further, the narrowing end portion (31) is formed with two small rhombus frames (39) at the outermost sides, the wide portion (32) is formed with two large rhombus frames (38) overlapping in between, where the two large rhombus frames (38) create a sub-large rhombus frame (37) at the overlapped portion. The sub-wide portion (33) is formed with medium rhombus frames (36) linked between the large and small rhombus frames (38, 39). The traversing link frame (34) is formed by successively splicing a plurality of rhombus frames of varied size.

Therefore, the resulted dust cloth can be manufactured by automation in one step, where the two lateral sides of the dust sheet consist of the fusing lines (3) of a narrowing geometric shape, which causes the fiber bundles or yarn (2) on the two lateral sides to become asymptotic curves to improve the cleaning capability and exterior appearance. Each of the fiber bundles or yarn (2) includes two or more fusing lines (3) to enhance the fusion strength of the fiber bundles or yarn (2).

Further, please refer to FIG. 3 to FIG. 6, the lengths of fiber bundles or yarn are controlled by the size of the nonwoven cloth (1), and spaced margins (11) are reserved on the two lateral sides by the fusing lines (3) of the size of the geometric frames for facilitating installation of dust mops of various widths. Moreover, the lengths and widths of the fiber bundles or yarn (2) may be varied, cooperating with the fan-out on the two lateral sides while practicing, the fiber bundles or yarn (2) are provided with sufficient movement freedom, whereby optimizing the dusting effect.

As shown in FIG. 5, another embodiment is provided, where a layer of nonwoven cloth (1) is added on an opposing side of the nonwoven cloth of the dust cloth, and the intermingled yarn of the intermediate layer is exposed appropriately. The excess portion of the added nonwoven cloth (1) is removed, such that the surrounding fiber bundles or yarn (2) directly contact the surface to be wiped while cleaning, and the strength of the intermingled yarn in the center portion is enhanced.

As shown in FIG. 8, still another embodiment is provided, where six positioning points (4) are disposed on the nonwoven cloth (1) of the dust cloth to facilitate slipping the mop rod into the reference points of the dust cloth.

Meanwhile, the cleaning side of the present invention is designated to be the side that is actually used for sweeping and includes intermingled yarn or other fibers for cleaning thereon. Moreover, besides the intermingled yarn disclosed in the aforementioned embodiments, fiber bundles or any equivalent material may be used to replace the intermingled yarn, and the dust cloth may also be made of hot melt or thermoplastic material, while the press-fusing lines may be generated by ultrasonic waves, sewing etc. besides fusing.

Further, since the distribution directions of the fiber bundles or yarn are in accordance with the wider side of the dust cloth, the contacting area between the fiber bundles or intermingled yarn and the article to be cleaned is increased to improve the cleaning effect. Also, since the nonwoven cloth and the fiber bundles or intermingled yarn are cut to the same length while manufacturing, they can be cut at the same time to shorten the manufacture process.

The connecting lines of the geometric frames disclosed above may also be non-successive, as long as the material of nonwoven cloth, fiber bundles, or intermingled yarn etc. of the present invention can be fixed.

To sum up, the present invention involves a dust cloth texture easy to be manufactured, which comprises geometric connecting lines with wide center portions and narrow margins, by which the lengths and widths of the fiber bundles or yarn are varied such that the movement freedom of the fiber bundles or yarn is increased to enhance the dusting effect. According to the above, compared with those of the prior art, the present invention is improved in its effect and provided with inventive step and industrial applicability this application is therefore proposed by law.

The detailed descriptions of the embodiments disclosed above are only provided for specifying the objects, features, and effects of the present invention, not for limiting the scope thereof, while modifications or alterations to the present invention may be made by those skilled in the art without departing from the scope and spirit of the present invention.

REFERENCE NUMERAL LIST

Figure 1:
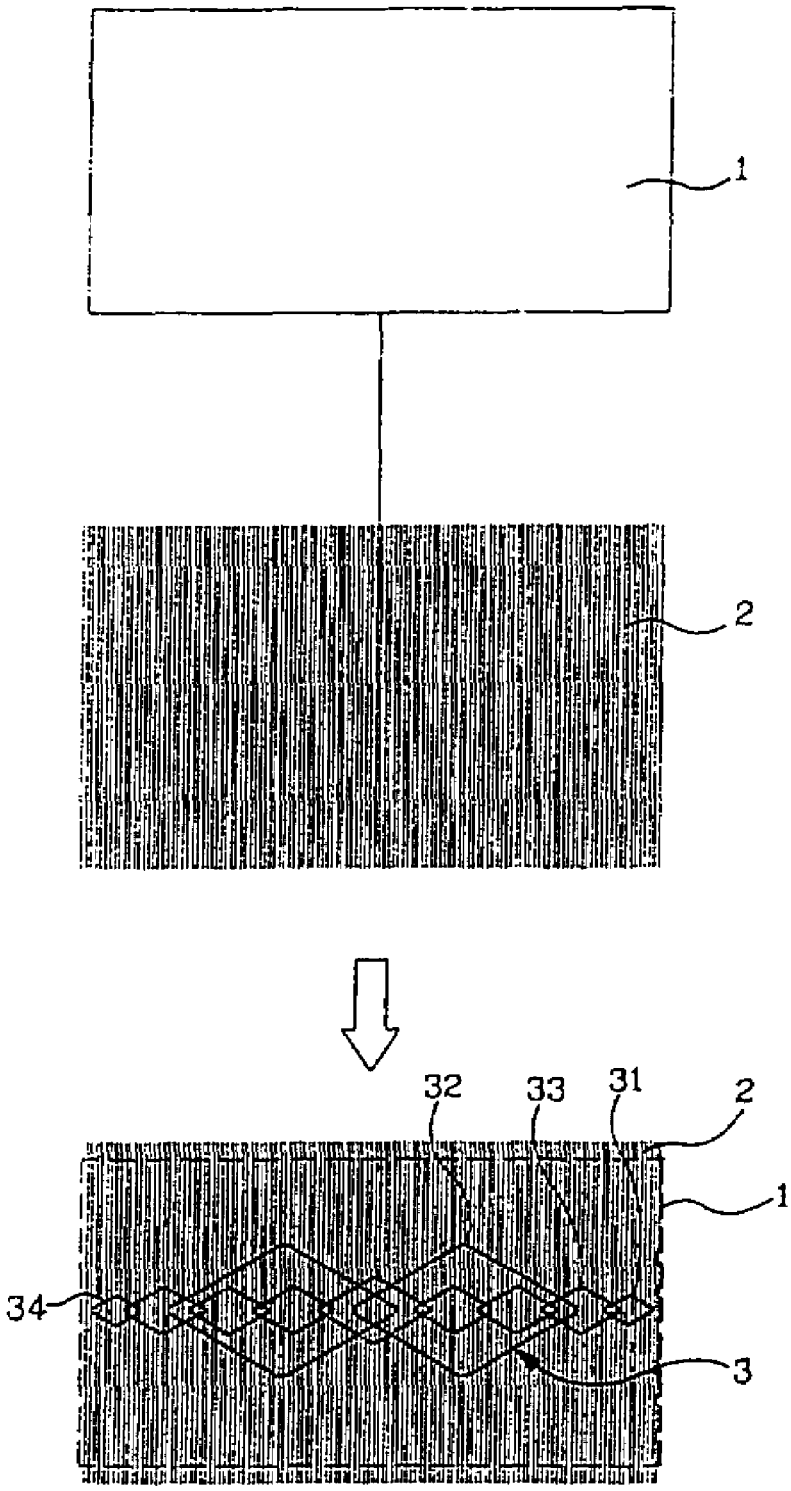
FIG. 1 shows a schematic view of the texture of the present invention.
Figure 2:
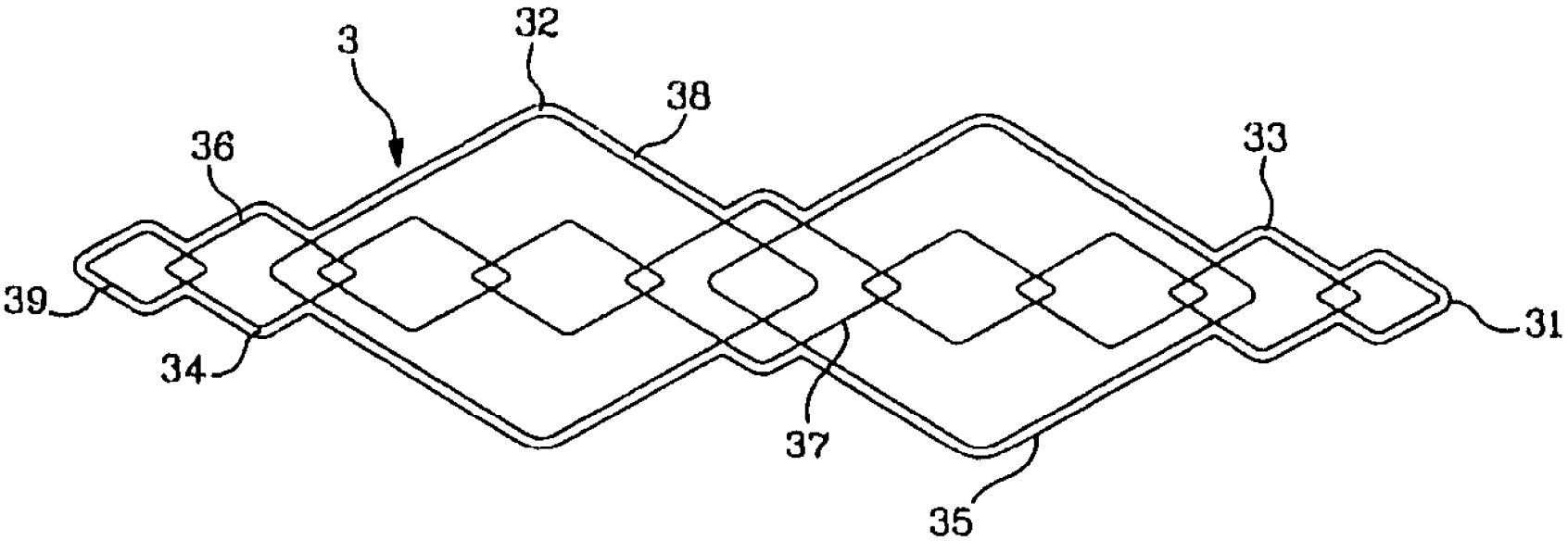
FIG. 2 is a best view of the distribution of the fusing lines of the present invention.
Figure 3:
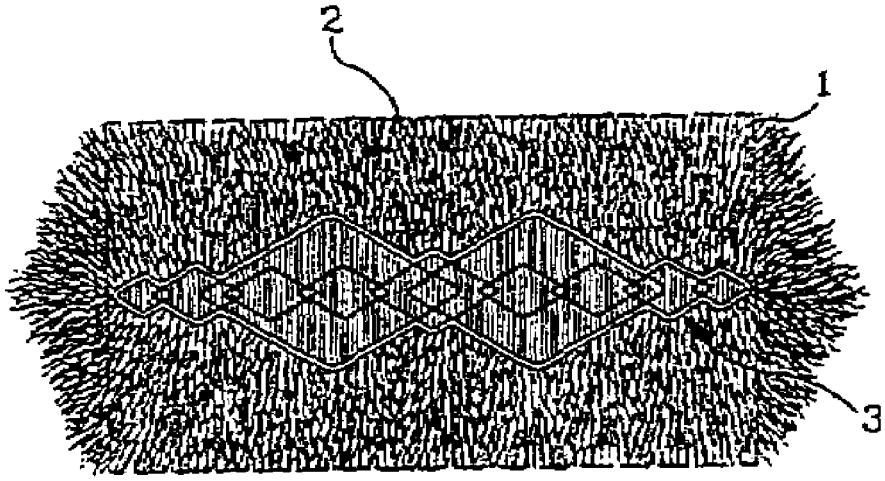
FIG. 3 is a front view of the dust cloth product of the present invention.
Figure 4:
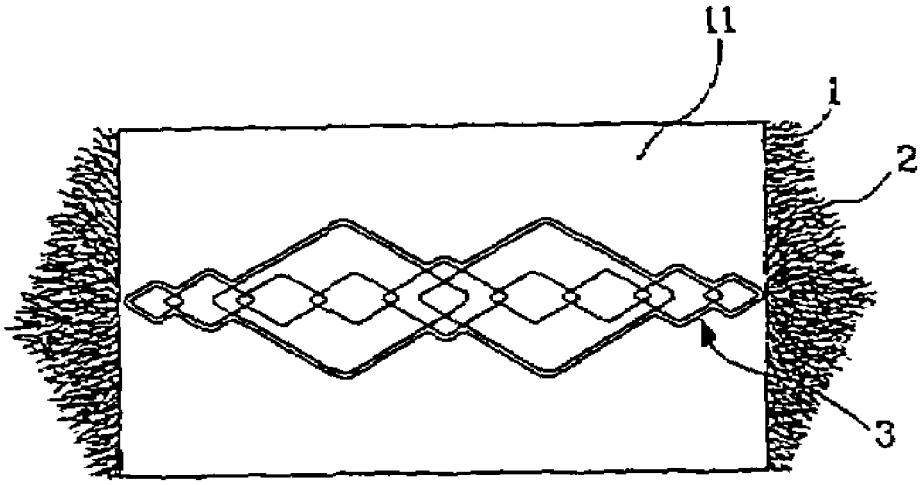
FIG. 4 is a rear view of the dust cloth product of the present invention.
Figure 5:
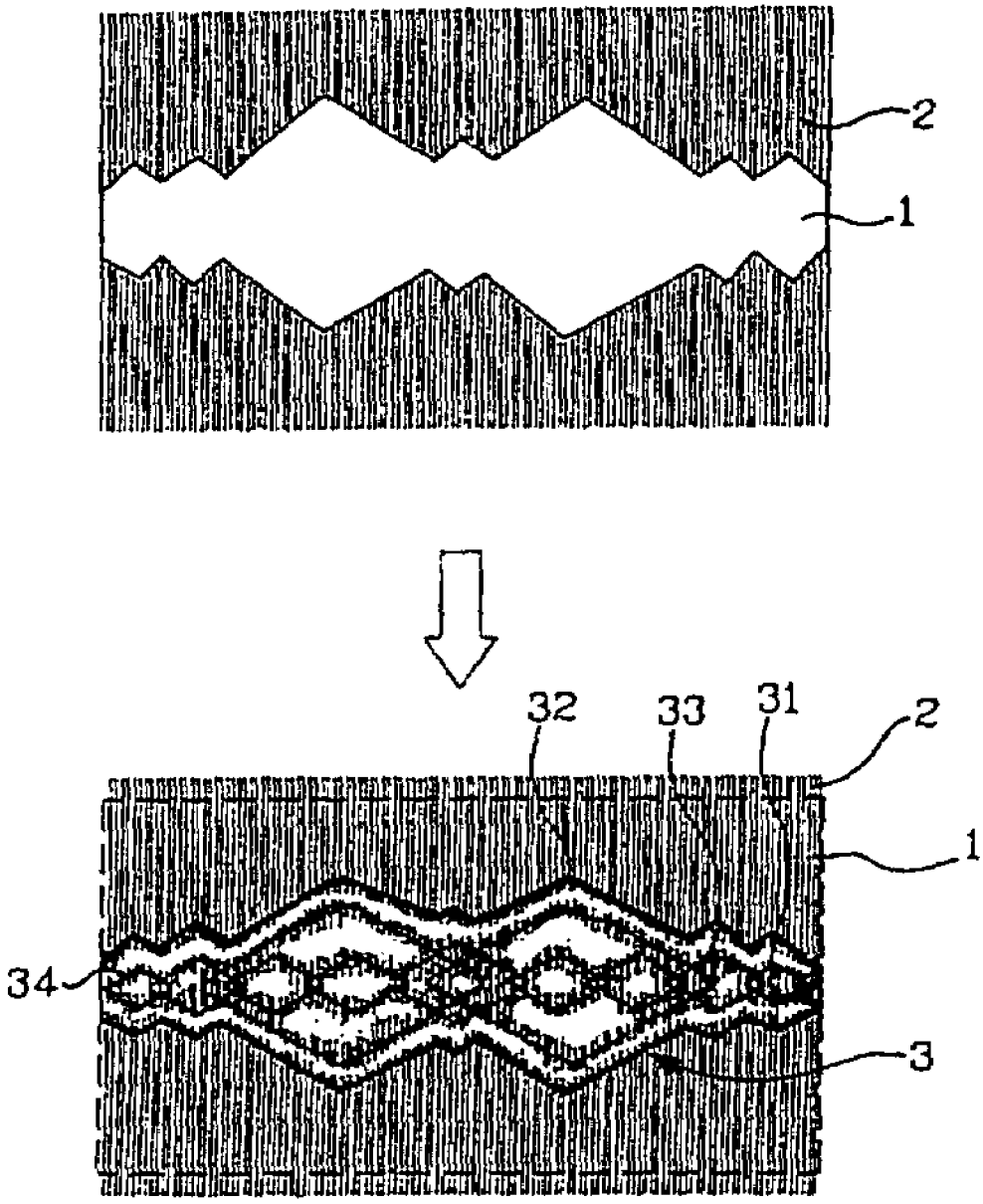
FIG. 5 is a bottom view of the dust cloth according to another embodiment of the present invention.
Figure 6:
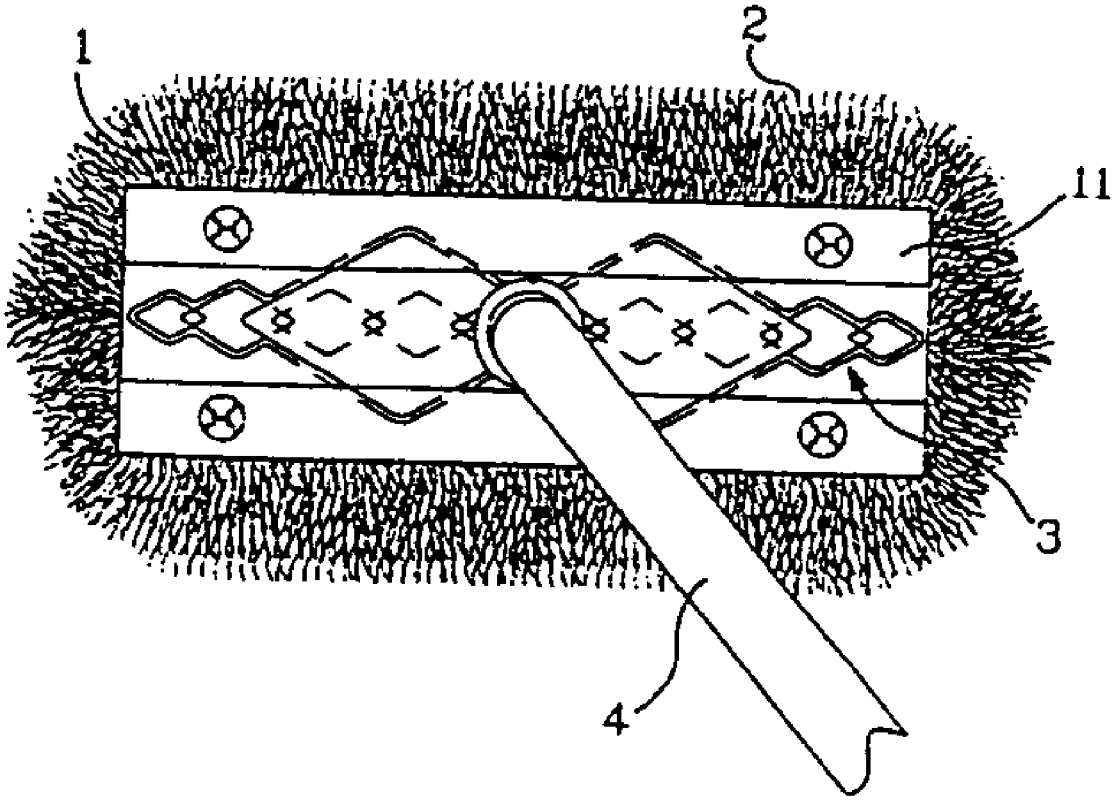
FIG. 6 is a view of the combination of the present invention and a mop rod.
Figure 7:
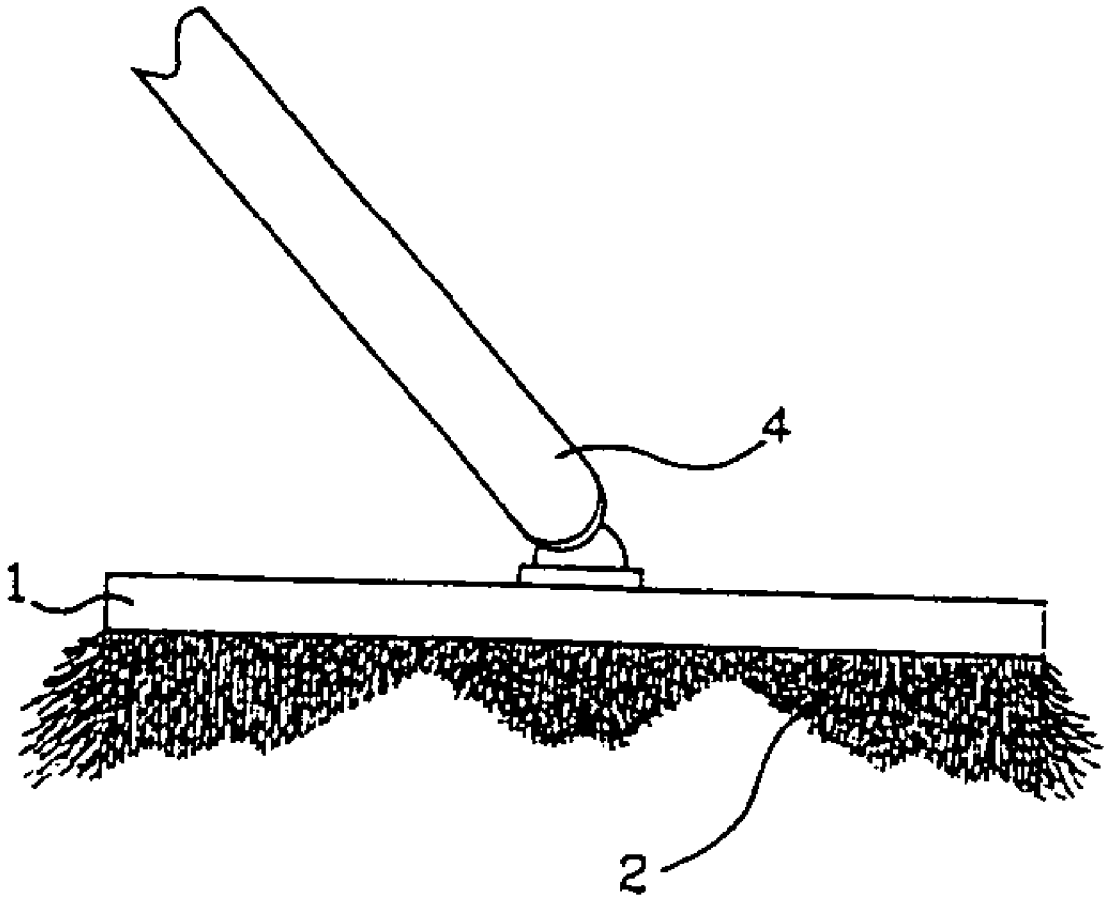
FIG. 7 is a schematic view of the present invention with piles of varied lengths.
Figure 8:
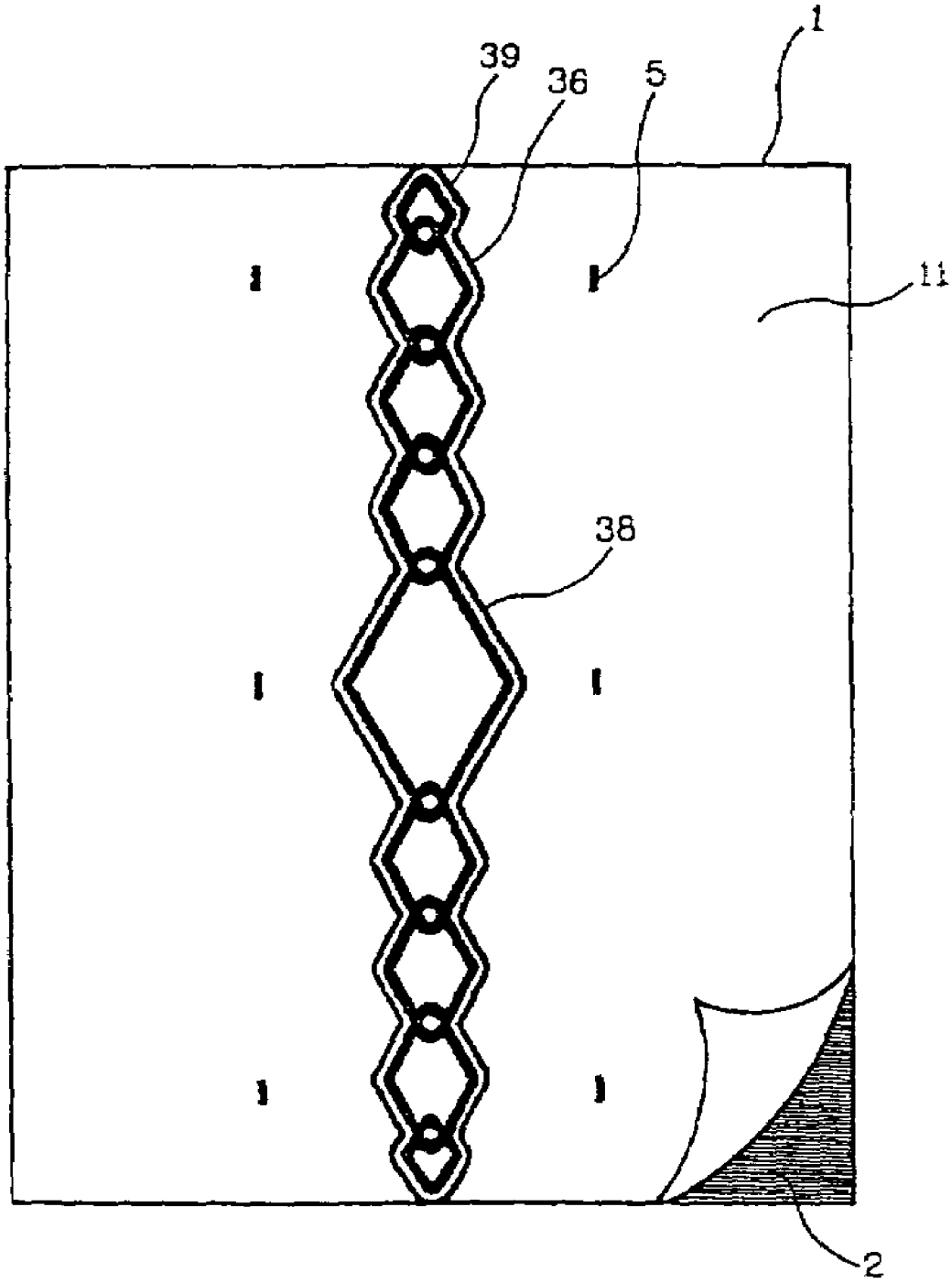
FIG. 8 is a schematic view of the positioning points on the nonwoven cloth of the dust cloth of the present invention.

1: nonwoven cloth
11: thin pipe
2: fiber bundles or yarn
3: fusing lines
31: end portion
32: wide portion
33: sub-wide portion
34: link frame
35: press-fusing margin
36: medium rhombus frame
37: sub-large rhombus frame
38: large rhombus frame
39: small rhombus frame
4: mop rod

What is claimed is:

1. A dust cloth texture having fiber bundles or bundles of intermingled yarn for dusting formed on a cleaning side of a piece of nonwoven cloth by press-fusing, which is characterized by that a plurality of press-fusing lines are formed on the dust cloth by successively or non-successively splicing a plurality of closed or open geometric frames, whereby the lengths and directions of the fiber bundles or intermingled yarn extending outside the frames are varied with the geometric shapes and angles of connecting lines, such that the freedom of distribution of the fiber bundles or yarn is increased and the dusting effect is optimized, wherein the geometric frames further comprise a narrowing end portion formed with two small rhombus frames at outermost sides of the geometric frames; a wide portion thereof is formed with two large rhombus frames overlapping in between, where the two large rhombus frames create a sub-large rhombus frame at the overlapped portion; a sub-wide portion is formed with medium rhombus frames linked between the large and small rhombus frames; and a traversing link frame is formed by successively splicing a plurality of rhombus frames of varied size.

2. The dust cloth texture according to claim 1, wherein one or more press-fusing margins is disposed outside the connecting lines, and the connecting lines are formed by soldering, fusing, gluing.

3. The dust cloth texture according to claim 1, wherein one or more layers of nonwoven cloth is added on an opposing side of the nonwoven cloth of the dust cloth to enhance a wiping strength of the fiber bundles or intermingled yarn disposed on an intermediate layer.

4. The dust cloth texture according to claim 3, wherein the fiber bundles or intermingled yarn on the intermediate layer are exposed on surrounding sides appropriately, so as to directly contact a surface to be wiped while wiping.

5. The dust cloth texture according to claim 1, wherein pluralities of positioning points are disposed on the cleaning side of the nonwoven cloth to facilitate positioning of a mop rod; the positions and number of the positioning points are varied with the setting position of the mop rod.

6. The dust cloth texture according to claim 1, wherein the distribution directions of the fiber bundles or intermingled yarn are in accordance with the wider side of the dust cloth, such that the contacting area between the fiber bundles or intermingled yarn and an article to be cleaned is increased to improve the cleaning effect.

7. The dust cloth texture according to claim 1, wherein the nonwoven cloth and the fiber bundles or intermingled yarn are cut to the same length while manufacturing, such that the manufacture process can be shortened since the nonwoven cloth and the fiber bundles or intermingled yarn are cut in one step.

8. A dust cloth texture having fiber bundles or bundles of intermingled yarn for dusting formed on a cleaning side of a piece of nonwoven cloth by press-fusing, which is characterized by that geometric frames formed with connecting lines on the dust cloth are disposed as a plurality of successively spliced link frames having wide center portions and narrow margins, whereby the fiber bundles or intermingled yarn inside the fusing frames are undulated to enhance the cleaning effect, wherein the geometric frames further comprise a narrowing end portion formed with two small rhombus frames at outermost sides of the geometric frames; a wide portion thereof is formed with two large rhombus frames overlapping in between, where the two large rhombus frames create a sub-large rhombus frame at the overlapped portion; a sub-wide portion is formed with medium rhombus frames linked between the large and small rhombus frames; and a traversing link frame is formed by successively splicing a plurality of rhombus frames of varied size.

9. The dust cloth texture according to claim 8, wherein the fiber bundles or intermingled yarn inside the fusing frames are undulated to create room for accommodating dust particles to prevent scratches of an article to be cleaned.

10. The dust cloth texture according to claim 2, wherein the fiber bundles or intermingled yarn inside the fusing frames are undulated to create three-dimensional room, such that the contact between the dust cloth and an article to be cleaned is soft, so as to extend the lifetime of the dust cloth.

* * * * *